US005465519A

United States Patent [19]

Blanck

[11] Patent Number: 5,465,519

[45] Date of Patent: Nov. 14, 1995

[54] LOCKING ASSEMBLY AND METHOD FOR A FIREARM

[75] Inventor: Edward Blanck, Camarillo, Calif.

[73] Assignee: Blue Sky Productions, Inc., Arlington, Va.

[21] Appl. No.: 261,096

[22] Filed: Jun. 16, 1994

[51] Int. Cl.[6] ..... F41A 17/42; F41A 17/02

[52] U.S. Cl. ..... 42/70.11; 42/70.01

[58] Field of Search ..... 42/70.01, 70.11; 89/148

[56] References Cited

U.S. PATENT DOCUMENTS

| | | | |
|---|---|---|---|
| 633,939 | 9/1899 | Ackerman | 42/70.11 |
| 1,226,566 | 5/1917 | Moore | 42/70.01 |
| 1,405,321 | 1/1922 | Peterson | 89/148 |
| 2,945,316 | 7/1960 | Mulno | 42/66 |
| 3,462,869 | 8/1969 | Wallace | 42/66 |
| 3,553,877 | 1/1971 | Welch, et al. . | |
| 3,605,311 | 9/1971 | Hermann | 42/70.11 |
| 3,673,725 | 7/1972 | Cravener | 42/70.08 |
| 3,735,519 | 5/1973 | Fox | 42/70.11 |
| 3,882,622 | 5/1975 | Perlotto | 42/70.11 |
| 4,136,475 | 1/1979 | Centille | 42/70.11 |
| 4,141,166 | 2/1979 | Schultz | 42/70.08 |
| 4,261,127 | 4/1981 | Karkkainen | 42/70.11 |
| 4,532,729 | 8/1985 | Von Muller | 42/70.11 |
| 4,654,992 | 4/1987 | Lavergne | 42/70.01 |
| 5,081,779 | 1/1992 | Pack | 42/70.11 |

FOREIGN PATENT DOCUMENTS

| | | | |
|---|---|---|---|
| 78449 | 12/1894 | Germany | 42/70.01 |
| 92831 | 12/1959 | Netherlands | 42/70.01 |

*Primary Examiner*—Stephen M. Johnson
*Attorney, Agent, or Firm*—Sherman and Shalloway

[57] ABSTRACT

The present invention presents a locking assembly which may be installed in a firearm during manufacture or as a retrofit to an existing firearm and which locks the bolt of the firearm against normal movement in the receiver. The assembly includes a cylinder lock installed in the stock of the firearm below the receiver and which has a locking element which is extendable through an aperture in the receiver to engage a blind aperture provided in the bolt. In this manner the assembly locks the bolt in a position which prevents loading and firing of the weapon and which also prevents its disassembly until the lock is released. The locking assembly may also be provided in kit form for retrofitting particular makes and models of firearms wherein the kit includes the lock assembly, a replacement receiver, a replacement bolt and a template for locating the position on the stock in which to install the lock assembly.

29 Claims, 5 Drawing Sheets

LOCKING ASSEMBLY AND METHOD FOR A FIREARM

FIELD OF THE INVENTION

The present invention relates to a locking assembly and a method for locking firearms. More particularly, the present invention relates to a method and a locking assembly used therewith for locking the bolt action of a firearm whereby use of the firearm is prevented until the locking assembly is released. Most particularly, the present invention relates to a locking assembly which is installed as an integral part of the firearm and which is operable independently of the trigger mechanism to lock the firing bolt in a position within the receiver such that the firearm cannot be loaded or discharged and which prevents disassembly of the firearm until the locking assembly is unlocked.

BACKGROUND OF THE INVENTION

There has been a constant need for safety devices in firearms to prevent their accidental discharge or use by unauthorized individuals. To this end, various locking devices and mechanisms have been developed to prevent operation of the firearm. Various devices are available which connect to the trigger housing of a firearm and lock the housing against access to the firearm trigger. With such devices, the firearm is not disabled by the locking mechansim but is simply rendered inoperable while the locking mechanism is in place on the trigger guard. Such mechanisms, since they are removable from the firearm, may be easily misplaced and lost.

In addition, devices are known for use in magazine type firearms, particularly those which employ a box type magazine, which fit into the magazine receiver in place of the normal magazine and which are locked in place. Such devices are similar to the trigger locks in that they merely render the weapon inoperable for use with a magazine. They may still permit the weapon to be used in a single shot fashion where each round is manually loaded. Also, like the trigger locks, since these devices are fully removable, they may be misplaced or lost, thus rendering them unusable.

It is therefore desirable to provide some form of locking mechanism which may be integrated with a firearm at manufacture or which may be readily retrofitted to existing firearms and which remains with the firearm at all times. It is also desirable to provide a simple locking mechanism which disables the firearm completely when locked but does not interfere with the normal operation of the firearm when the mechanism is unlocked. Furthermore, it is desirable to provide a locking mechanism which locks the firearm in such a manner that disassembly of the firearm in order to remove the locking mechanism is not possible while the firearm is locked. The prior art includes several attempts which have been made to fill the need for such a device.

U.S. Pat. No. 633,939 to Ackerman discloses a locking device for shotgun break levers. Operation with a key selectively moves a pin into position within a socket in the break lever to lock the lever in position and thereby prevent the weapon from being opened. This mechanism does not prevent the weapon from being discharged in the event that the lock is set after the weapon is loaded.

U.S. Pat. No. 2,945,316 to Mulno discloses a safety lock for firearms in which a threaded means is operated by a removable key to be advanced or retracted so as to engage a part of the firing mechanism of the weapon in which it is installed. The device includes a structure to prevent operation by other than the proper key.

U.S. Pat. No. 3,462,869 to Wallace discloses a key operated safety device for firearms which places a cylinder lock in an opening in the hammer of the weapon. In order to release the lock and permit operation of the weapon the lock must be substantially withdrawn from the weapon.

U.S. Pat. No. 3,553,877 to Welch discloses a firearm safety device which makes use of a key lock mechansim and an actuator arm to shift a lever into a position where it prevents movement of the weapon's integral safety mechanism from a "safe" to a "fire" position. This device operates through interfacing with the complex trigger mechanism.

U.S. Pat. No. 3,673,725 to Cravener discloses a locking arrangement using a key device which selectively positions a hammer rod obstruction into the rearward path of the weapon's hammer. The obstruction prevents the hammer from being withdrawn. In alternative embodiments, the device operates to bind other moving parts of a firearm such as a safety release lever.

U.S. Pat. No. 3,735,519 to Fox discloses a locking device that prevents movement of the weapon's safety to a firing position. The lock includes a combination tumbler requiring that the proper combination of numbers be arranged to disconnect the lock and allow the sear to pivot away from the bolt, thereby enabling the bolt to move. This device has a complexity level which renders it appropriate only for installation at the time of the weapon's manufacture inasmuch as it engages the trigger mechanism.

U.S. Pat. No. 3,882,622 to Perlotto discloses a locking device to lock a weapon safety latch mechanism into position. This device requires extensive tooling to fit it into place and is more suited to integral manufacture with the weapon, rather than as a retrofit.

U.S. Pat. No. 4,136,475 to Centille discloses a safety device for firearms which causes a locking pin to be shifted into position to prevent operation of the firearm trigger. The device makes use of a rack and pinion gear linkage by which the locking pin is movable into engagement with the trigger seat.

U.S. Pat. No. 4,261,127 to Karkkainen discloses a safety lock for firearms having a wooden stock with a pistol end wherein the lock is mounted in the pistol end and employs a flexible shaft for transmitting the movement of the tumbler to a member which engages and blocks the operation of the trigger mechanism of the weapon. Such flexible shafts are often susceptible to binding thus rendering the mechanism unreliable nor does this mechanism prevent disassembly of the weapon.

U.S. Pat. No. 5,081,779 to Pack discloses a safety lock for firearms which includes a hammer pin which is in constant contact with the hammer of the firearm and which can be locked into position by aligning a lock surface with a plunger. If the hammer pin jams or binds in any way it may prevent operation of the lock or the weapon even when the mechanism is unlocked.

The prior art presents locking mechanisms which are complex, which may be subject to interference or jamming and which are therefore unreliable. Others do not lend themselves to ease of use or installation either during manufacture or as a retrofit to existing weapons. Furthermore, the prior art does not disclose a locking apparatus which both locks the weapon against use and prevents its disassembly in order to circumvent the locking mechanism. The need therefore remains for a simple, effective and reliable apparatus for locking firearms against unauthorized use in which the locking mechanism operates to prevent the movement of a key element in the firing mechanism of the firearm and which prevents disassembly of the firearm in order to circumvent the locking mechanism.

SUMMARY OF THE INVENTION

It is an object of the present invention to provide a method and apparatus for locking a firearm against unauthorized use which is simple and easy to use.

It is a further object to provide a locking assembly for firearms which positively locks the bolt in the receiver of a firearm without interfering with any other mechanisms of the weapon.

It is also an object of the present invention to provide a locking assembly for firearms which prevents disassembly of the firearm to circumvent the locking mechanism.

It is a still further object of the present invention to provide a locking mechanism for a firearm which may be installed during the manufacture of the firearm or as a retrofit into existing firearms.

It is an even further object of the present invention to provide a kit for installing a locking mechanism as a retrofit into an existing firearm.

Further objects and advantages will become evident from the following description.

The present invention provides a locking assembly for a firearm having a stock, a trigger mechanism, a receiver positioned along an upper side of the stock and a bolt housed within the receiver and reciprocatable therein whereby a round is chambered and fired. The receiver has an aperture in its lower wall and the bolt is provided with a blind aperture in its underside which is alignable with the receiver aperture. The locking assembly comprises a lock sleeve positioned vertically in the stock forward of the trigger assembly and below the receiver in line with the receiver aperture. A lock body is retained in the lock sleeve and is adapted to protrude through the receiver aperture to releasably engage the bolt.

The present invention also provides a firearm comprising a stock having an upper surface and a lower surface and housing a trigger mechanism, a receiver attached to the upper surface of the stock and capable of receiving ammunition and a firing bolt reciprocatingly housed in the receiver and actuatable by the trigger mechanism to discharge the firearm. The receiver has an aperture in its lower wall adjacent the upper surface of the stock while the bolt is provided with a blind aperture in its under side to be alignable with the receiver aperture. A lock mechanism is mounted in the stock forward Of said trigger mechanism and extends vertically from the lower surface of the stock to the upper surface in line with the receiver aperture. The lock mechansim includes a locking element which is extendable through the receiver aperture to releasably engage the blind aperture in the bolt and lock the bolt against movement within the receiver.

The present invention also provides a method of locking a firearm against use by unauthorized individuals and against disassembly wherein the firearm comprises a stock, a trigger mechanism in the stock, a receiver mounted on the upper surface of the stock and a bolt reciprocatingly housed within the receiver. The method comprises the steps of providing a vertical aperture in the stock forward of the trigger mechanism and extending from the underside of the stock upwards to the receiver and adapted to receive a lock mechanism; providing an aperture in the wall of the receiver which is in line with the stock aperture and which is adapted to permit passage of a lock element; providing a blind aperture in the bolt whereby the blind aperture is alignable with the receiver aperture and the stock aperture by partially drawing the bolt and is adapted to receive a lock element; and mounting a cylinder lock mechanism within the stock aperture wherein the lock mechanism comprises a lock element which is extendable through the receiver aperture and receivable within the blind aperture in the bolt whereby the bolt is releasably fixed against movement within the receiver at a position between its fully drawn position and its fully forward position and whereby the bolt cannot be fully drawn for removal from the receiver until the lock is released.

The present invention also provides a kit for retrofitting a locking assembly to a firearm having a stock housing a trigger mechanism, a receiver mounted on the upper surface of the stock and a bolt housed within the receiver for reciprocating movement therein, wherein the kit comprises a replacement receiver having an aperture cut into its lower wall, a replacement bolt having a blind aperture formed in its lower surface and having a shape and size to receive part of a lock mechanism, a lock mechanism for implantation into the stock below the receiver and at a point corresponding to the receiver aperture, and a template positionable on the stock to indicate the location for drilling an aperture in the stock to accommodate the lock mechanism so that the aperture will be in line with the receiver aperture.

DETAILED DESCRIPTION OF THE INVENTION

The present invention will be described in combination with a semi-automatic, bolt action rifle having a box magazine ammunition feed. However, it is applicable to any type of bolt action firearm from a single shot, manually operated rifle to a multi-shot, fully automatic weapon, and may be adapted for use on firearms having box magazines or tubular magazines.

Figure 1:
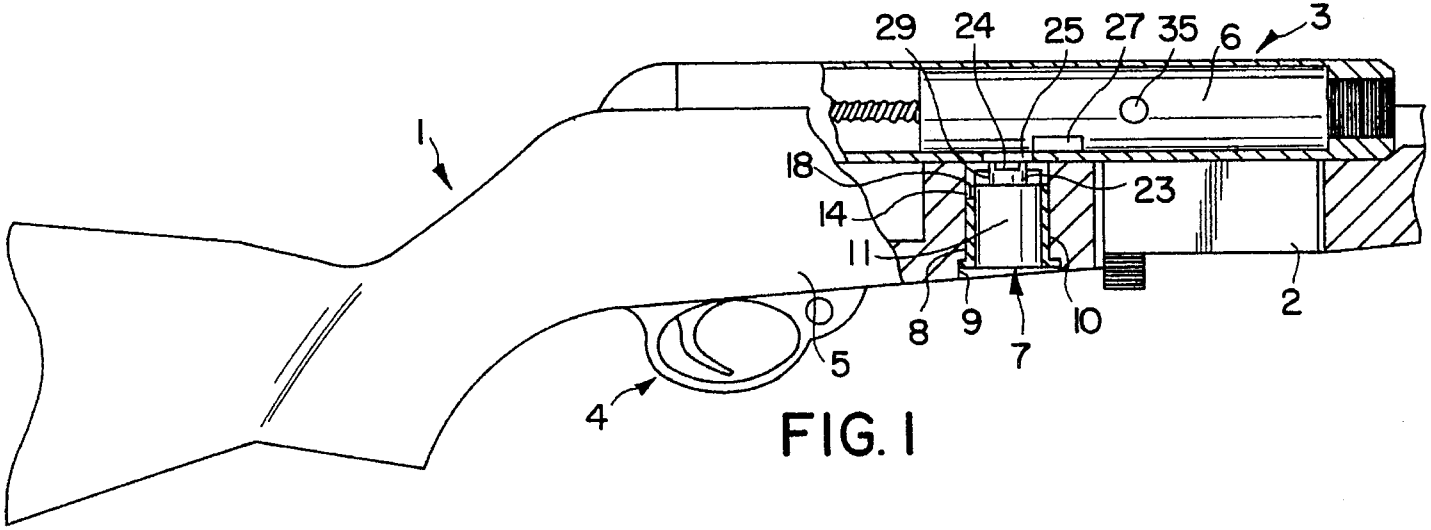
FIG. 1 is a partial cut-away view of a rifle showing the locking assembly of the present invention in the unlocked position.
Figure 2:
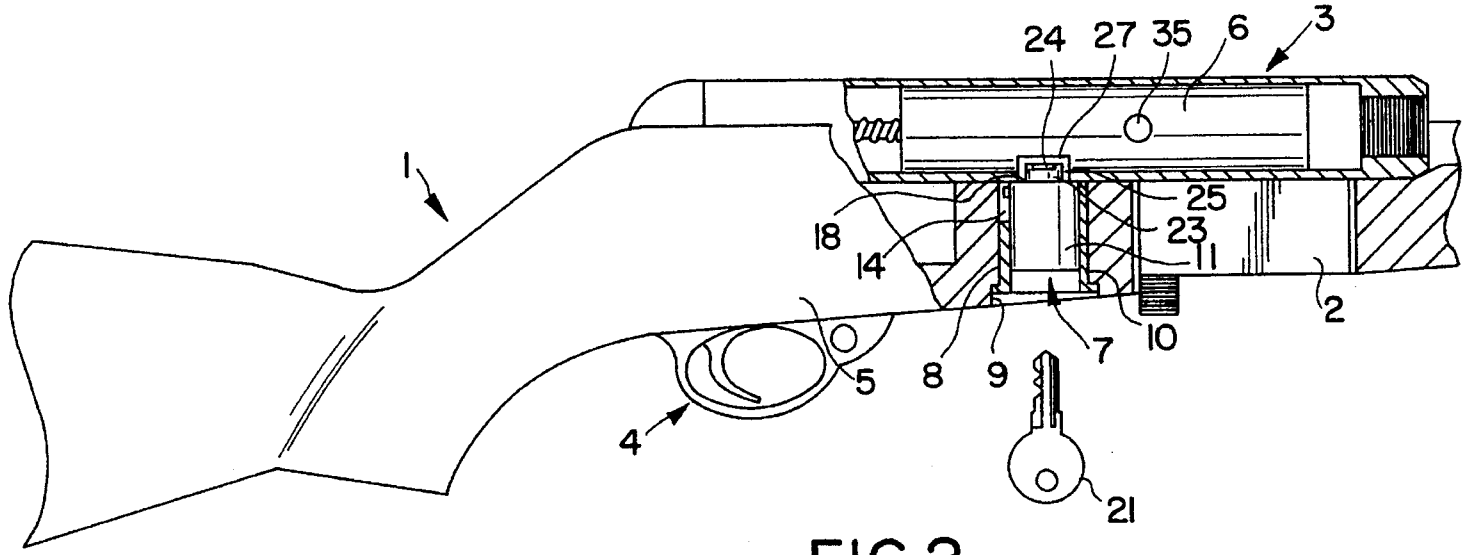
FIG. 2 is a partial cut-away view of a rifle showing the locking assembly of the present invention in the locked position.
Figure 14:
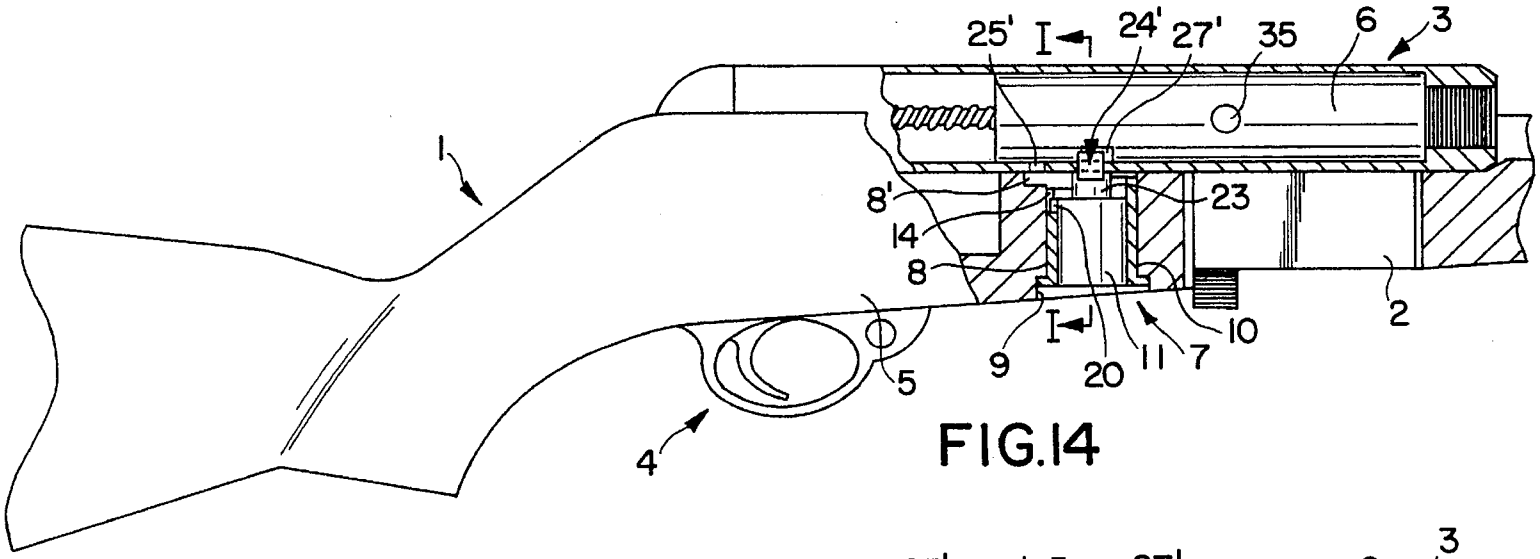
FIG. 14 is a partial cut-away view of a rifle showing an alternative embodiment of the locking assembly of the present invention in the unlocked position.
Figure 15:
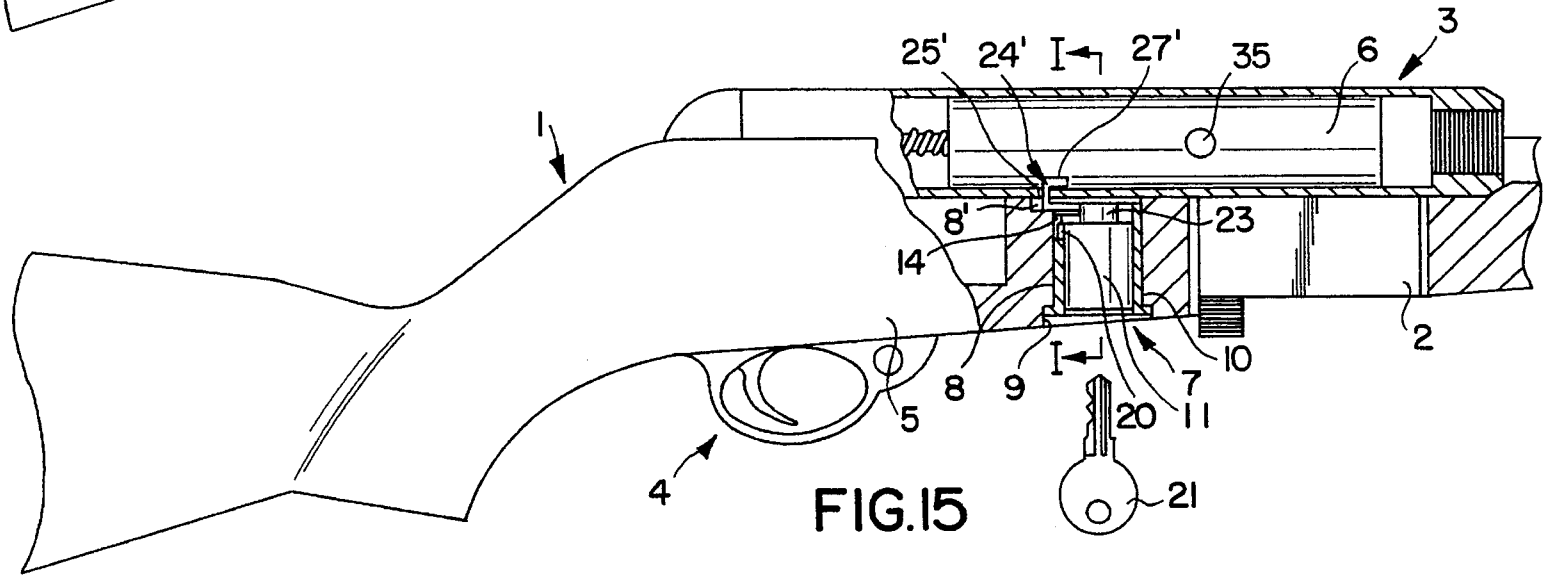
FIG. 15 is a partial cut-away view of a rifle showing the alternative embodiment of the locking assembly of the present invention in the locked position.

FIGS. 1, 2, 14 and 15 illustrate the locking assembly of the present invention installed in a semi-automatic rifle 1 which uses a box magazine 2 to supply ammunition to receiver 3 with FIGS. 1 and 2 illustrating a first embodiment and FIGS. 14 and 15 illustrating a second embodiment. A trigger mechanism 4 is housed in stock 5 rearward of magazine 4 and a bolt 6 is reciprocatingly housed in receiver 3. The locking assembly of the present invention comprises three essential parts, receiver 3, bolt 6 and a cylinder lock assembly 7 mounted in stock 5 below receiver 3 and between trigger mechanism 4 and magazine 2. Receiver 3, bolt 6 and cylinder lock assembly 7 cooperate to provide a method and assembly for positively locking a firearm against unauthorized use and disassembly.

Cylinder lock assembly 7 fits into an aperture 8 drilled vertically through stock 5 so as to extend completely through stock 5 and expose the underside of receiver 3. The lower end of aperture 8 is preferably recessed 9 for a reason which will become evident. Within aperture 8 is fit cylinder lock assembly 7 which includes a lock sleeve 10 and cylinder lock 11. These items are more fully illustrated in FIGS. 8–12, 20 and 21.

Figure 9:
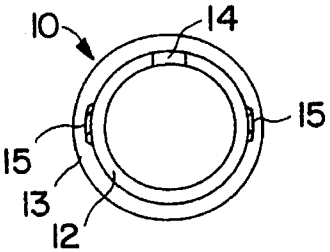
FIG. 9 is a top view of the lock sleeve of FIG. 8.
Figure 12:
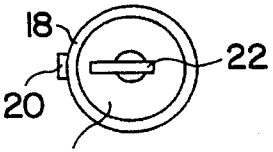
FIG. 12 is a bottom view of the lock body of FIG. 10.
Figure 8:
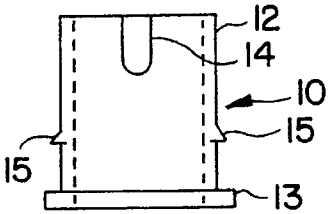
FIG. 8 is a side view of a lock sleeve of the locking assembly of the present invention.
Figure 11:
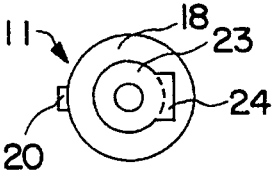
FIG. 11 is a top view of the lock body of FIG. 10.

Lock sleeve 10 comprises a cylindrical wall 12 with a horizontally, outwardly extending flange 13 about its lower end. In the upper end of cylinder wall 12 is a blind slot 14 which extends partway downward from the upper edge of sleeve 10. Preferably, sleeve 10 is provided with means to retain sleeve 10, and thereby the entire lock assembly 7, within aperture 8 in stock 5. Such means may take the form of teeth or detents 15 formed on the outer surface of cylindrical wall 12 as shown in FIGS. 8 and 9. Such teeth 15 will engage and dig into the material of stock 5 when sleeve 10 is inserted and will resist withdrawal of sleeve 10. In addition, by providing aperture 8 with recess 9, flange 13 is recessed within stock 5 thereby making it more difficult to pry sleeve 10 out of aperture 8.

Figure 3:
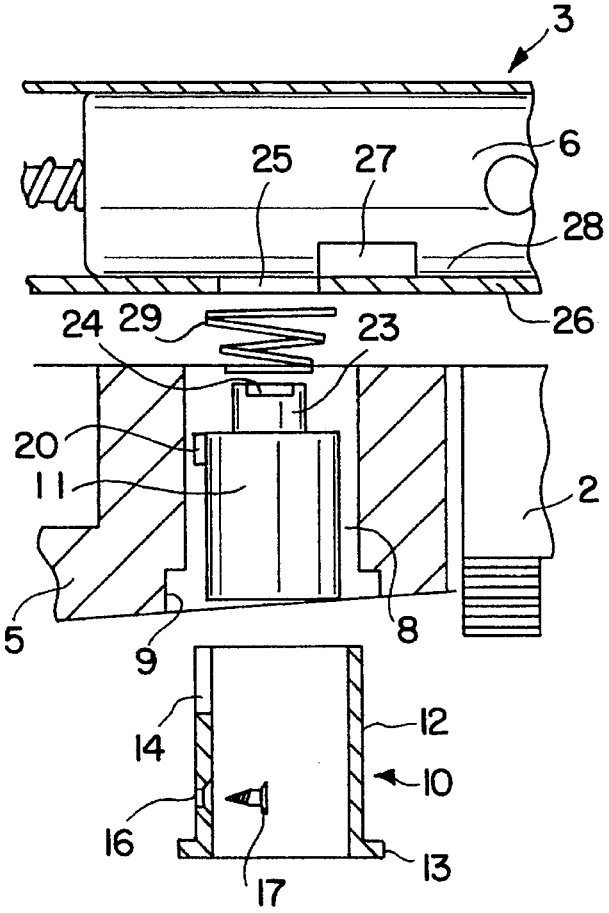
FIG. 3 is an enlarged exploded view of the locking assembly of the present invention.

An alternative means for retaining sleeve 10 in aperture 8 is shown in FIG. 3 wherein sleeve 10 is provided with a horizontal aperture 16 through wall 12 whereby a screw 17 or similar fastener may pass through to securely fasten sleeve 10 within stock 5. Preferably aperture 16 is countersunk on the inner surface of wall 12 so that the head of screw 17 does not interfere with the operation of cylinder lock 11. Also preferably, when this means for securing sleeve 10 is used, the aperture 16 is placed at a level within sleeve 10 so as to be covered by cylinder lock 11 when the weapon is fully assembled. In this manner, the lock assembly 11 may not be removed without disassembling the weapon and, as will be seen hereinafter, this is not possible unless the lock assembly 7 is unlocked.

In the first embodiment, as seen in FIGS. 1–3, cylinder lock 11 fits into sleeve 10 and is slidable therein between locked and unlocked positions. Cylinder lock 11 comprises a lock shell 18 and tumbler 19. Shell 18 is provided with a tab 20 extending laterally adjacent the upper edge of shell 18. Tab 20 fits in blind slot 14 of sleeve 10 and this combination serves to both guide cylinder lock 11 in its vertical travel within sleeve 10 and prevent rotation of lock shell 18 when tumbler 19 is rotated between locked and unlocked positions. Furthermore, because blind slot 14 and tab 20 are at the upper ends of their respective lock elements, when the weapon is fully assembled with the lock assembly 7 in place, cylinder lock 11 is securely confined within stock 5 and cannot be removed.

Tumbler 19 preferably comprises a standard key actuated cylinder lock tumbler mechanism and is rotatable within lock shell 18. A key 21 fits into keyway 22 in tumbler 19 to unlock the mechanism and permit rotation of tumbler 19. On the upper end of tumbler 19 is lock cam 23 which comprises an extension of tumbler 19 with a partial flange 24 extending laterally from its upper end to form a lip. Inasmuch as lock cam 23 is part of tumbler 19 it will rotate with tumbler 19 between locked and unlocked positions and relative to shell 18.

Figure 7:
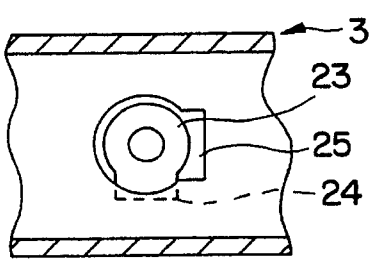
FIG. 7 is a view inside the receiver of a firearm showing the lock in the unlocked position.
Figure 6:
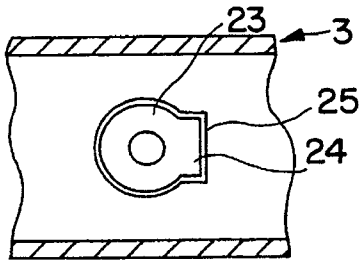
FIG. 6 is a view inside the receiver of a firearm showing the lock in an intermediate position alinged with the receiver aperture.
Figure 5:
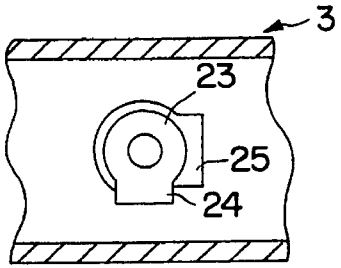
FIG. 5 is a view inside the receiver of a firearm showing the lock in the locked position.
Figure 10:
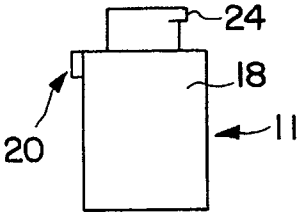
FIG. 10 is a side view of the lock body of the locking assembly of the present invention.

As seen in the drawing figures, lock assembly 7 fits into stock 5 forward of trigger mechanism 4 and immediately below receiver 3. Furthermore, as noted previously, receiver 3 and bolt 6 are integral parts of the entire locking assembly of the present invention. Toward this end, receiver 3 is provided with an aperture 25 in its lower wall 26. Aperture 25 is located so as to be positioned over and in line with hole 8 of stock 5 when the weapon is assembled. Furthermore, as shown in FIGS. 5–7, where bolt 6 has been omitted for clarity, aperture 25 has a shape which corresponds to the overall shape of lock cam 23 with its integral partial flange 24. In this manner, cylinder lock 11 can be actuated so that lock cam 23 will pass through aperture 25 when tumbler 19 is rotated to the unlocked position as shown in FIG. 6, but will not pass through when tumbler 19 is in the locked position, shown in FIGS. 5 and 7. FIG. 5 is a view inside receiver 3 showing lock cam 23 in its position when the firearm is locked with lock cam 23 turned so that partial flange 24 overlaps the edge of aperture 25. This view corresponds to the view in FIG. 2 wherein cylinder lock 11 has been pushed upward to extend lock cam 23 through aperture 25 into receiver 3 and blind aperture 27 in bolt 6. In FIG. 6, lock cam 23 has been rotated to the unlocked position so that lock cam 23 and partial flange 24 are lined up with aperture 25 and may pass through aperture 25. FIG. 6 illustrates lock cam 23 retracted from receiver 3 through aperture 25 and rotated to the locked position to prevent inadvertent passage back through aperture 25 into receiver 3 when the firearm is being operated. This view corresponds to the view given in FIG. 1.

Since bolt 6 fits closely within receiver 3 and since one object of the present invention is to provide a locking assembly whereby bolt 6 is locked against movement within receiver 3, bolt 6 is provided with blind aperture 27 in its lower surface 28 to receive lock cam 23 when it is extended through aperture 25 and rotated to the locked position. This relationship is clearly shown in FIG. 2. Although blind aperture 27 may be located at any point along the length of bolt 6, it is preferably located so that bolt 6 must be partially drawn rearward to line up blind aperture 27 with aperture 25. Furthermore, blind aperture 27 is of a size to accept lock cam 23 and partial flange 24 regardless of the position of rotation of tumbler 19.

In order to ensure that cylinder lock 11 retracts from engagement with receiver 3 and bolt 6 when it is unlocked, a spring 29 is provided between the top of cylinder lock 11 and the underside of receiver 3 within aperture 8. When lock assembly 7 is locked, spring 29 is compressed between lock cylinder 11 and receiver 3. Upon unlocking of assembly 7, spring 29 forces lock cylinder downward so that lock cam 23 is positively removed from engagement with receiver 3 and bolt 6. The strength of spring 29 also maintains cylinder lock in the retracted position shown in FIG. 1 to prevent inadvertent engagement of lock cam 23 with bolt 6 during operation of the firearm. As pointed out above, tab 20 on cylinder lock shell 18 is confined within blind slot 14 in sleeve 10 thus providing a guide for the vertical movement of cylinder lock 11 between its extended and retracted positions. Furthermore, blind slot 14 serves to trap tab 20 between receiver 3 and the bottom of blind slot 14 so that cylinder lock 11 cannot be removed from the weapon. In a similar manner, since most weapons of this type require that the bolt be drawn fully rearward before it can be removed from the receiver and the receiver removed from the stock, the locking assembly of the present invention also prevents removal of bolt 6 which, in turn prevents access to lock assembly 7 by removal of receiver 3. Thus, when lock assembly 7 is engaged with bolt 6 and locked into position, neither bolt 6, receiver 3 nor lock assembly 7 may be removed from the firearm.

Figure 4:
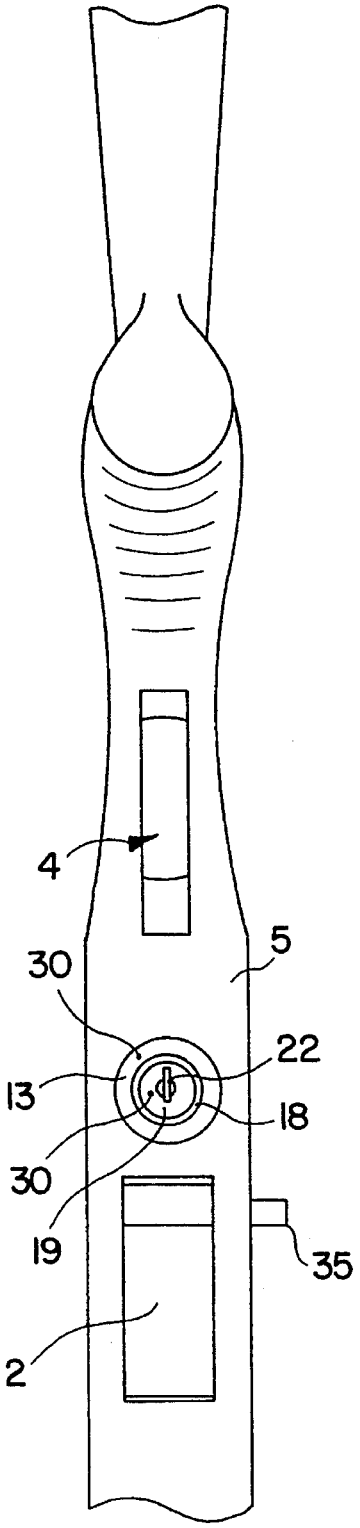
FIG. 4 is a view of the underside of a rifle with the locking assembly of the present invention.

As FIG. 4 shows, the lock assembly 7 may be provided with indicia 30 on the lower end of tumbler 19 and the outer surface of sleeve flange 13 to indicate whether tumbler 19 is turned to the locked or unlocked position.

The locking assembly of the present invention may be easily and readily incorporated into the manufacturing process of firearms with a minimum of added steps to the process. Specifically, aperture 8 and recess 9 must be drilled in stock 5 and may be done contemporaneously with the milling of the trigger locations, magazine receiving apertures, and the like. In cases of firearms where the stock is molded from a polymer, aperture 8 and recess 9 may be drilled after molding or the mold may be modified so that aperture 8 and recess 9 are formed at the time of molding. Similarly, aperture 25 in receiver 3 and blind aperture 27 in bolt 6 may be formed at the time these pieces are forged, cast or stamped, or aperture 25 and blind aperture 27 may be milled in their respective parts after manufacture.

Figure 13:
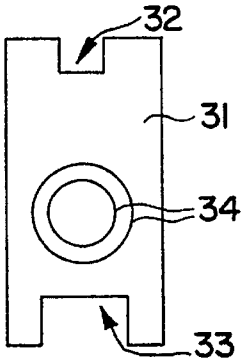
FIG. 13 is a planar view of a template for use with a kit for retrofit installation of the locking assembly of the present invention.

The locking assembly of the present invention may also be provided as an aftermarket kit for retrofitting to existing firearms by gunsmiths or gun owners. Toward this end, such a kit includes lock assembly 7, a replacement receiver 3 and a replacement bolt 6 all sized to fit a specific brand and model of firearm. In addition, a template is included to provide an accurate guide for drilling aperture 8 and recess 9 in the stock of the firearm for which the kit is supplied. FIG. 13 illustrates a prospective template 31 for such a kit which is provided with a trigger notch 32 and a magazine notch 33. Markings 34 are provided to indicate the size and location for drilling aperture 8 and recess 9 relative to the location on the firearm of trigger assembly 4 and magazine 2. Preferably, when template 31 is placed on the lower surface of stock 5 between trigger assembly 4 and magazine 2, notch 32 will embrace trigger assembly 4 and notch 33 will embrace magazine 2. Template 31 may then be temporarily secured to stock 5 and aperture 8 and recess 9 drilled at the locations indicated by markings 34. The firearm is disassembled before drilling.

Following drilling of aperture 8 and recess 9, lock sleeve 10 is inserted into aperture 8 from the underside of stock 5 and is secured therein. Cylinder lock 11 is then inserted into sleeve 10 from the upper side of stock 5 and spring 29 is set in place. With lock assembly 7 in place, the replacement receiver 3 is installed with aperture 25 in line with aperture 8 and cylinder lock 11. Replacement bolt 6 is then installed and the firearm is reassembled.

To lock a firearm in which the first embodiment of the locking assembly of the present invention is installed, bolt 6 is drawn to line up blind aperture 27 with receiver aperture 25. Using key 21, tumbler 19 is rotated to the unlocked position shown in FIG. 6 to align lock cam 23 with aperture 25 and cylinder lock 11 is pushed upward against spring 29 so that lock cam 23 passes through aperture 25 into blind aperture 27. Tumbler 19 is then turned to the locked position shown in FIG. 5 and key 21 is removed. In the locked position of FIG. 5, lock cam 23 has been turned out of alignment with aperture 25 so that partial flange 24 engages the inner surface of receiver 3 and prevents spring 29 from retracting cylinder lock 11. Furthermore, since lock cam 23 also extends into blind aperture 27, bolt 6 is prevented from moving forward or backward within receiver 3 and is prevented from being fully withdrawn from receiver 3 thus preventing disassembly of the firearm. Without such disassembly, removal of cylinder lock 11 is not possible without causing significant damage to stock 5. By locating blind aperture 27 such that, when locked, bolt 6 is neither fully forward nor fully rearward, the firearm may be locked so that it is in a non-cocked condition and the firing chamber is blocked so that a round of ammunition cannot be chambered. Preferably blind aperture 27 is located on bolt 6 so that bolt 6 need be drawn rearward only a short way to align blind aperture 27 with receiver aperture 25.

To unlock the firearm, bolt 6 may be held in place by cocking lever 35 while tumbler 19 is turned to the unlocked position of FIG. 6 using key 21. Spring 29 will then force cylinder lock 11 to retract within sleeve 10 thus moving lock cam 23 out of engagement with bolt 6 and receiver 3. Bolt 6 will then be released for movement within receiver. As a safety precaution, tumbler 19 should be rotated to the locked position and key 21 removed following unlocking of the weapon. In this manner, lock cam 23 will be positioned as shown in FIG. 7 and it will not be possible to inadvertently re-engage lock cam 23 with bolt 6 while the weapon is being fired.

In the second embodiment of the present invention illustrated in FIGS. 14–21, the parts, assembly and general operation of the locking assembly are substantially identical to those of the first embodiment with the exception that the locking action of the second embodiment is achieved through rotation of the lock tumbler only. In the second embodiment cylinder lock 11 is not required to move vertically within lock sleeve 10. However, lock shell 18 is prevented from rotating relative to lock sleeve 10 by the same cooperation of blind slot 14 and tab 20 as in the first embodiment.

Figure 16:
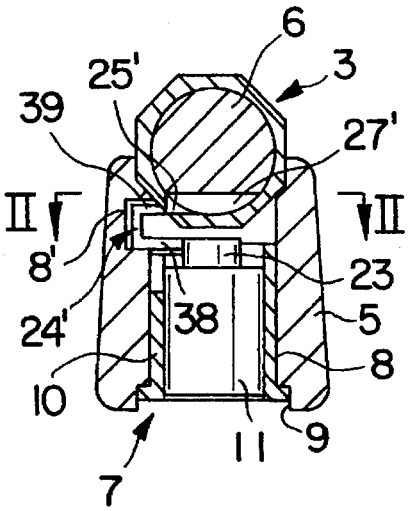
FIG. 16 is a cross-section taken along line I—I of FIG. 14 showing the alternative embodiment of the locking assembly of the present invention in the unlocked position.
Figure 17:
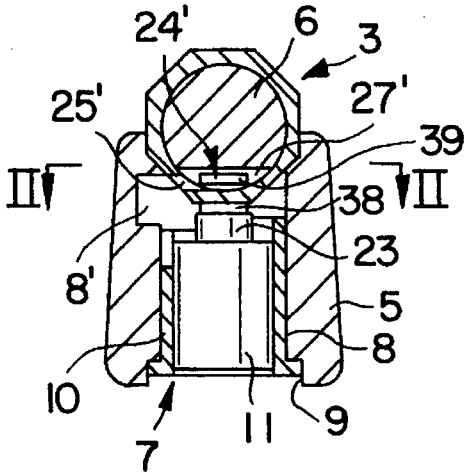
FIG. 17 is a cross-section taken along line I—I of FIG. 15 showing the alternative embodiment of the locking assembly of the present invention in the locked position.

FIGS. 14 and 15 illustrate the second embodiment in a semi-automatic rifle 1 as before and in the unlocked and locked positions respectively. FIGS. 16 and 17 are cross-sections taken along lines I—I of FIGS. 14 and 15, while FIGS. 18 and 19 are cross-sections along lines II—II of FIGS. 16 and 17 looking down into receiver 3 with bolt 6 omitted for clarity.

Figure 18:
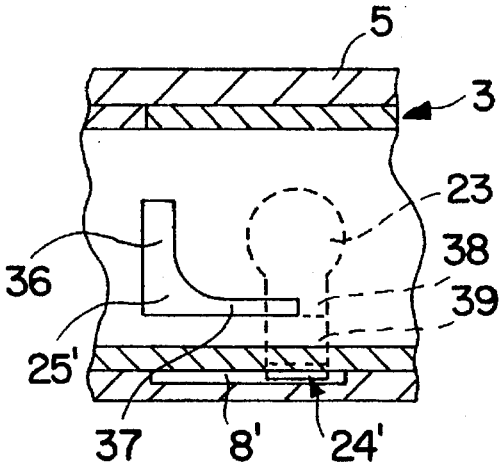
FIG. 18 is a view along line II—II of FIG. 16 showing the inside of the receiver with the alternative embodiment of the locking assembly of the present invention in the unlocked position.
Figure 19:
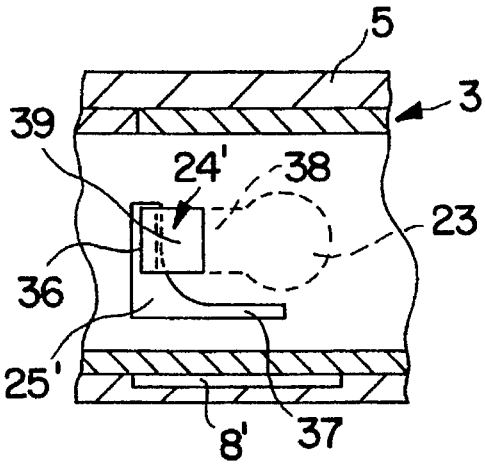
FIG. 19 is a view along line II—II of FIG. 17 showing the inside of the receiver with the alternative embodiment of the locking assembly of the present invention in the locked position.
Figure 20:
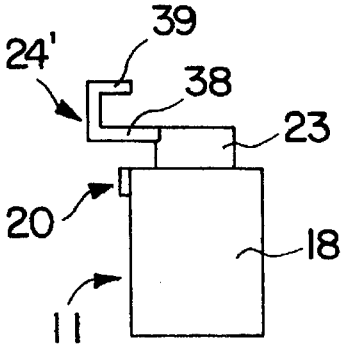
FIG. 20 is a side view of the alternative embodiment of the lock body of the present invention.
Figure 21:
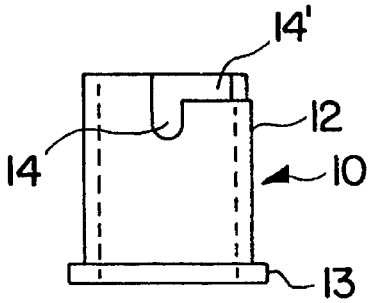
FIG. 21 is a side view of the alternative embodiment of the lock sleeve of the present invention.

In the second embodiment, receiver aperture 25' comprises a substantially L-shaped cut-out in the lower wall of receiver 3 as shown in FIGS. 18 and 19. Aperture 25' has a first leg 36 transverse to the longitudinal axis of receiver 3 and a second leg 37 running parallel to the longitudinal axis along the lower edge of receiver 3. As with receiver aperture 25 of the first embodiment, receiver aperture 25' is located so as to be substantially in line with stock aperture 8 in order to receive a locking member 24' extending from lock cam 23.

Corresponding to partial flange 24, locking member 24' extends from lock cam 23 on the upper end of tumbler 19 and is substantially C-shaped. Lower leg 38 of locking member 24' connects to cam 23 and upper leg 39 traverses receiver aperture 25' as tumbler 19 is rotated relative to lock shell 18. In this manner, locking member 24' is rotatable through an arc of about 45° between an unlocked position where it is outside of receiver 3, as shown in FIGS. 16 and 18, to a locked position where it traverses receiver aperture 25' and upper leg 39 of locking member 24' passes through transverse leg 36 of receiver aperture 25' to engage blind aperture 27' of bolt 6. To facilitate engagement of locking member 24', blind aperture 27' of bolt 6 is preferably a transverse slot milled across the lower surface of bolt 6 in substantially the same position as blind aperture 27 of the first embodiment so that bolt 6 must be drawn partially rearward for locking as shown in FIG. 15.

In order to accomodate locking element 24' when cylinder lock 11 is unlocked, a slot 8' is milled into stock 5 along one side of receiver 3 at the upper end of aperture 8. Additionally, the upper edge of lock sleeve 10 is preferably relieved 14' through the arc of rotation between locked and unlocked positions for passage of locking element 24'.

To lock a firearm in which the second embodiment of the locking assembly is installed, bolt 6 is partially drawn to align blind aperture 27' with transverse leg 36 of receiver aperture 25'. Using key 21, tumbler 19 is rotated from the unlocked position to the locked position whereby locking member 24' is caused to traverse the legs of receiver aperture 25' and engage blind aperture 27' of bolt 6. To unlock the firearm, the procedure is reversed while holding bolt 6 in place by cocking lever 35. As an aid to alignment of bolt 6 for locking with either embodiment of the present invention, the outer surface of receiver 3 may be provided with a mark or indicia with which to align cocking lever 35 and to indicate that bolt 6 is properly positioned for locking within receiver 3.

While the invention has been shown and described in a preferred embodiment, it is to be understood that this disclosure is for the purpose of illustration and that various changes and modifications may be made without departing from the spirit and scope of the invention as set forth in the appended claims.

What is claimed is:

1. A locking mechanism for a firearm having a stock, a trigger mechanism, a receiver positioned along an upper side of said stock and having an aperture in a lower wall thereof and a bolt housed within said receiver and reciprocatable therein, said locking mechanism comprising;

a lock sleeve positioned vertically in said stock forward of said trigger assembly and below said receiver, said lock sleeve having means to retain said sleeve within said stock, and a lock body permanently retained in said lock sleeve and having means adapted to protrude through said aperture in said receiver to releasably engage said bolt;

wherein, said lock body comprises a cylindrical lock shell, a key actuated tumbler rotatable within said shell and having a keyway accessible from one end of said tumbler and a lock cam extending from the opposite end of said tumbler, whereby insertion of a key into said keyway permits rotation of said tumbler within said shell between a locked position and an unlocked position and concurrent rotation of said lock cam between a locked position and an unlocked position, said bolt is provided with a slot capable of being positioned over said receiver aperture and of receiving said lock cam, and wherein said receiver aperture and said lock cam have corresponding irregular shapes whereby said cam is capable of passing through said aperture only when in rotational alignment therewith and whereby said rotational alignment corresponds to the unlocked position of said tumbler mechanism, whereby said bolt is maintained in an inoperative position when said lock body is engaged.

2. The locking mechanism of claim 1 wherein said means to retain said sleeve within said stock comprises fasteners inserted through said sleeve into said stock.

3. The locking mechanism of claim 1 wherein said means to retain said sleeve within said stock comprises detents on the outer surface of said sleeve which engage said stock upon insertion of said sleeve therein and which prevent withdrawal of said sleeve from said stock.

4. The locking mechanism of claim 1 wherein said lock body is vertically slidable within said lock sleeve and further comprises a compression spring positioned within said lock sleeve between said lock body and the underside of said receiver and encircling said lock cam, whereby said spring urges said lock body downward whereby said lock cam is forced out of engagement with said receiver and said bolt when said tumbler is rotated to the unlocked position.

5. The locking mechanism of claim 4 further comprising an indexing means whereby said lock sleeve and said lock body are maintained in relative operating engagement, rotation of said lock shell relative to said sleeve is prevented and said lock body is prevented from being removed from said lock sleeve without first dismantling said receiver from said stock.

6. The locking mechanism of claim 5 wherein said indexing means comprises a tab extending laterally from said lock shell and a cooperating blind slot in said lock sleeve.

7. The locking mechanism of claim 6 wherein said blind slot is located in an upper portion of said lock sleeve and extends downward from the upper edge of said sleeve a distance sufficient to permit said lock body to fully retract from engagement with said bolt and said receiver when said tumbler mechanism is unlocked.

8. The locking mechanism of claim 1 further comprising indicia on said lock body and said lock sleeve whereby said locked and said unlocked positions are indicated.

9. The locking mechanism of claim 1 wherein said receiver aperture comprises a substantially L-shaped cut-out wherein a first leg is transverse to the longitudinal axis of said receiver and a second leg is parallel to the longitudinal axis of said receiver.

10. The locking mechanism of claim 9 wherein said lock cam comprises a first leg extending laterally from said tumbler, a transition piece extending upward from the end of said first leg and a second leg extending parallel to said first leg, whereby said lock cam has a substantially C-shape and whereby said second leg engages and traverses said receiver aperture.

11. The locking mechanism of claim 10 further comprising an indexing means whereby said lock sleeve and said lock body are maintained in relative operating engagement, rotation of said lock shell relative to said sleeve is prevented and whereby said lock body is prevented from being removed from said lock without first dismantling said receiver from said stock.

12. The locking mechanism of claim 11 wherein rotation of said tumbler and said lock cam is restricted to an arc between full locked and full unlocked positions.

13. The locking mechanism of claim 12 wherein rotation of said tumbler and said lock cam is restricted to an arc of 45°.

14. The locking mechanism of claim 11 wherein said indexing means comprises a tab extending laterally from the upper edge of said lock shell and a cooperating blind slot in said lock sleeve.

15. A firearm comprising;

a stock having an upper surface and a lower surface and housing a trigger mechanism, a receiver attached to said upper surface of said stock and capable of receiving ammunition and having an aperture in a lower wall thereof, a firing bolt reciprocatingly housed in said receiver and actuatable by said trigger mechanism and having a blind hole therein which hole is indexable with said receiver aperture, and a non-removable lock mechanism permanently mounted in said stock forward of said trigger mechanism and below said receiver and in line with said receiver aperture, whereby said lock mechanism extends from said lower surface to said upper surface of said stock and comprises means to releasably engage said blind hole in said bolt through said receiver aperture to thereby lock said bolt at a point midway in its reciprocating motion within said receiver.

16. The firearm of claim 15 wherein said lock mechanism comprises:

a cylindrical sleeve permanently mounted through the lower surface of said stock and providing a passageway from said lower surface to the underside of said receiver in line with the aperture in said receiver, and a lock body retained and operable within said sleeve between a locked position and an unlocked position and comprising a cylindrical lock shell housing a rotatable lock tumbler, said tumbler having a lock cam extending therefrom which, when said lock body is placed in the locked position, passes through said aperture in said receiver and engages said blind hole in said bolt.

17. The firearm of claim 16 wherein said lock sleeve comprises a cylindrical sleeve wall having an outwardly extending peripheral flange about the bottom edge thereof, a blind slot extending downward from the upper edge thereof and retention means to hold said sleeve within said stock.

18. The firearm of claim 17 wherein said cylindrical lock shell is of a size to slidably fit within said lock sleeve and includes means to engage said blind slot whereby said shell is retained within said lock sleeve and is prevented from rotating relative to said lock sleeve and wherein said lock tumbler is rotatable within said lock shell between locked and unlocked positions whereby said lock cam thereon is rotatable between locked and unlocked positions.

19. The firearm of claim 18 wherein said receiver aperture and said lock cam have corresponding irregular shapes whereby said cam is capable of passing through said aperture only when in rotational alignment therewith and whereby said rotational alignment corresponds to the unlocked position of said tumbler.

20. The firearm of claim 19 further comprising a spring positioned between said lock body and said receiver whereby said lock body is urged downward by said spring and out of engagement with said receiver and said bolt when said tumbler is rotated to said unlocked position.

21. The firearm of claim 18 wherein said lock cam comprises a substantially C-shaped member extending laterally from the upper end of said tumbler and wherein said receiver aperture comprises a substantially L-shaped cut-out with one arm of said L transverse to the longitudinal axis of said receiver and the other arm of said L parallel to the longitudinal axis of said receiver, whereby rotation of said tumbler causes said cam to traverse said aperture between of said lock body, whereby said firearm is locked when said cam traverses said transverse arm and said firearm is unlocked when said cam traverses said parallel arm.

22. A method of locking a firearm against use by unauthorized individuals wherein the firearm comprises a stock, a trigger mechanism in said stock, a receiver mounted on the upper surface of said stock and a bolt reciprocatingly housed within said receiver, the method comprising:

providing a vertical aperture in said stock forward of said trigger mechanism and extending from the underside of said stock upwards to said receiver and which is adapted to receive a non-removable lock mechanism permanently mounted therein, providing an aperture in the wall of said receiver whereby said aperture is in line with said stock aperture and is adapted to permit passage of a lock element therethrough, providing a blind hole in said bolt whereby said blind hole is alignable with said receiver aperture and said stock aperture and is adapted to receive said lock element, and permanently mounting said lock mechanism within said stock aperture wherein said lock mechanism comprises a cylinder lock comprising said lock element telescopically extendable through said receiver aperture and receivable within said blind hole in said bolt whereby said bolt is releasably fixed against movement within said receiver.

23. The method of claim 22 comprising partially drawing said bolt to align said blind hole with said receiver aperture, extending said lock element through said receiver aperture and into said blind hole, locking said lock mechanism whereby said lock element is fixed in place within said blind hole, and releasing said bolt, whereby said bolt is retained in position and is prevented from reciprocating within said receiver and whereby said firearm is prevented from being loaded and from being discharged until said lock mechanism is released and whereby said bolt is prevented from being fully drawn for removal from said receiver until said lock mechanism is released.

24. The method of claim 23 further comprising providing means to cause said lock element to retract from said blind hole and said receiver aperture when said lock mechanism is unlocked.

25. A kit for retrofitting a locking mechanism to a firearm having a stock housing a trigger mechanism, a receiver mounted on the upper surface of said stock and a bolt housed within said receiver for reciprocating movement therein, wherein the kit comprises:

a replacement receiver having an aperture cut into the lower wall thereof, a replacement bolt having a blind hole formed in the lower surface thereof and corresponding substantially to the shape and size of the receiver aperture, a lock mechanism for implantation into the stock below the receiver and at a point corresponding to the receiver aperture, and a template positionable on the stock to indicate the location for drilling an aperture in said stock to accommodate the lock mechanism.

26. The kit of claim 25 wherein the template is configured to align with a standard and existing part of the firearm whereby the location of the aperture in the stock for the lock mechanism may be properly located relative to the aperture in the replacement receiver.

27. The kit of claim 25 wherein the lock mechanism comprises a cylinder lock having a lock body telescopically extendable within a lock sleeve and a bolt engaging element on the inner end of said lock body whereby said lock body is extendable within said sleeve whereby said bolt engaging element passes through said receiver aperture and is receivable in said blind hole upon extension of said lock body.

28. The kit of claim 27 further comprising a biasing means on said lock body whereby said lock body is urged to telescopically retract into said lock sleeve when said lock mechanism is unlocked.

29. The kit of claim 25 wherein the lock mechanism comprises a cylinder lock having a lock body within a lock sleeve adapted to be fixedly mounted within said aperture in said stock wherein said lock body comprises a non-rotatable lock shell and a rotatable and lockable tumbler wherein said tumbler includes a locking member capable of traversing said receiver aperture and engaging or disengaging said bolt when said tumbler is rotated between locked and unlocked positions.

* * * * *